US005380345A

United States Patent [19]

Cherpeck

[11] Patent Number: 5,380,345

[45] Date of Patent: Jan. 10, 1995

[54] POLYALKYL NITRO AND AMINO AROMATIC ESTERS AND FUEL COMPOSITIONS CONTAINING THE SAME

[75] Inventor: Richard E. Cherpeck, Cotati, Calif.

[73] Assignee: Chevron Research and Technology Company, San Francisco, Calif.

[21] Appl. No.: 162,416

[22] Filed: Dec. 3, 1993

[51] Int. Cl.[6] ..... C10L 1/18

[52] U.S. Cl. ..... 44/399; 44/410; 560/23; 560/43

[58] Field of Search ..... 560/23, 43; 44/399, 44/405, 410

[56] References Cited

U.S. PATENT DOCUMENTS

| | | | |
|---|---|---|---|
| 2,252,089 | 8/1941 | Miller | 44/399 |
| 2,714,607 | 8/1955 | Matter | 260/471 |
| 3,149,933 | 9/1964 | Ley et al. | 44/75 |
| 3,285,855 | 11/1966 | Dexter et al. | 252/57 |
| 3,434,814 | 3/1969 | Dubeck et al. | 44/69 |
| 3,849,085 | 11/1974 | Kreuz et al. | 44/78 |
| 3,929,864 | 12/1975 | Papenfuss | 560/23 |
| 4,058,550 | 11/1977 | Shepherd et al. | 560/43 |
| 4,134,846 | 1/1979 | Machleder et al. | 252/51.5 A |
| 4,231,759 | 11/1980 | Udelhofen et al. | 44/75 |
| 4,320,020 | 3/1982 | Lange | 252/51.5 R |
| 4,320,021 | 3/1982 | Lange | 252/51.5 R |
| 4,328,322 | 5/1982 | Baron | 521/163 |
| 4,347,148 | 8/1982 | Davis | 252/51.5 R |
| 4,386,939 | 6/1983 | Lange | 44/63 |
| 4,859,210 | 8/1989 | Franz et al. | 44/53 |
| 5,090,914 | 2/1992 | Reardan et al. | 435/188 |
| 5,196,142 | 3/1993 | Mollet et al. | 252/311 |
| 5,196,565 | 3/1993 | Ross | 560/55 |
| 5,211,721 | 5/1993 | Sung et al. | 44/389 |

FOREIGN PATENT DOCUMENTS

| | | |
|---|---|---|
| 6169650 | 5/1980 | Japan . |
| 6201645 | 1/1984 | Japan . |

*Primary Examiner*—Prince Willis, Jr.
*Assistant Examiner*—Cephia D. Toomer
*Attorney, Agent, or Firm*—C. J. Caroli

[57] ABSTRACT

Polyalkyl nitro and amino aromatic esters having the formula:

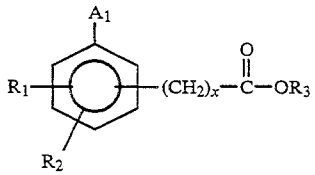

(I)

wherein $A_1$ is nitro, amino, N-alkylamino wherein the alkyl group contains 1 to 6 carbon atoms, or N,N-dialkylamino wherein each alkyl group independently contains 1 to 6 carbon atoms; $R_1$ and $R_2$ are independently hydrogen, hydroxy, lower alkyl having 1 to 6 carbon atoms, or lower alkoxy having 1 to 6 carbon atoms; $R_3$ is a polyalkyl group having a weight average molecular weight in the range of about 450 to 5,000; and x is an integer from 0 to 10.

The polyalkyl nitro and amino aromatic esters of formula I are useful as fuel additives for the prevention and control of engine deposits.

49 Claims, No Drawings

POLYALKYL NITRO AND AMINO AROMATIC ESTERS AND FUEL COMPOSITIONS CONTAINING THE SAME

BACKGROUND OF THE INVENTION

1. Field of the Invention

This invention relates to novel nitro and amino aromatic compounds. More particularly, this invention relates to novel polyalkyl nitro and amino aromatic esters and their use in fuel compositions to prevent and control engine deposits.

2. Description of the Related Art

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

For example, aliphatic hydrocarbon-substituted phenols are known to reduce engine deposits when used in fuel compositions. U.S. Pat. No. 3,849,085, issued Nov. 19, 1974 to Kreuz et al., discloses a motor fuel composition comprising a mixture of hydrocarbons in the gasoline boiling range containing about 0.01 to 0.25 volume percent of a high molecular weight aliphatic hydrocarbon-substituted phenol in which the aliphatic hydrocarbon radical has an average molecular weight in the range of about 500 to 3,500. This patent teaches that gasoline compositions containing minor amounts of an aliphatic hydrocarbon-substituted phenol not only prevent or inhibit the formation of intake valve and port deposits in a gasoline engine, but also enhance the performance of the fuel composition in engines designed to operate at higher operating temperatures with a minimum of decomposition and deposit formation in the manifold of the engine.

Similarly, U.S. Pat. No. 4,134,846, issued Jan. 16, 1979 to Machleder et al., discloses a fuel additive composition comprising a mixture of (1) the reaction product of an aliphatic hydrocarbon-substituted phenol, epichlorohydrin and a primary or secondary mono- or polyamine, and (2) a polyalkylene phenol. This patent teaches that such compositions show excellent carburetor, induction system and combustion chamber detergency and, in addition, provide effective rust inhibition when used in hydrocarbon fuels at low concentrations.

Amino phenols are also known to function as detergents/dispersants, antioxidants and anti-corrosion agents when used in fuel compositions. U.S. Pat. No. 4,320,021, issued Mar. 16, 1982 to R. M. Lange, for example, discloses amino phenols having at least one substantially saturated hydrocarbon-based substituent of at least 30 carbon atoms. The amino phenols of this patent are taught to impart useful and desirable properties to oil-based lubricants and normally liquid fuels. Similar amino phenols are disclosed in related U.S. Pat. No. 4,320,020, issued Mar. 16, 1982 to R. M. Lange.

Similarly, U.S. Pat. No. 3,149,933, issued Sep. 22, 1964 to K. Ley et al., discloses hydrocarbon-substituted amino phenols as stabilizers for liquid fuels.

U.S. Pat. No. 4,386,939, issued Jun. 7, 1983 to R. M. Lange, discloses nitrogen-containing compositions prepared by reacting an amino phenol with at least one 3- or 4-membered ring heterocyclic compound in which the hetero atom is a single oxygen, sulfur or nitrogen atom, such as ethylene oxide. The nitrogen-containing compositions of this patent are taught to be useful as additives for lubricants and fuels.

Nitro phenols have also been employed as fuel additives. For example, U.S. Pat. No. 4,347,148, issued Aug. 31, 1982 to K. E. Davis, discloses nitro phenols containing at least one aliphatic substituent having at least about 40 carbon atoms. The nitro phenols of this patent are taught to be useful as detergents, dispersants, antioxidants and demulsifiers for lubricating oil and fuel compositions.

Similarly, U.S. Pat. No. 3,434,814, issued Mar. 25, 1969 to M. Dubeck et al., discloses a liquid hydrocarbon fuel composition containing a major quantity of a liquid hydrocarbon of the gasoline boiling range and a minor amount sufficient to reduce exhaust emissions and engine deposits of an aromatic nitro compound having an alkyl, aryl, aralkyl, alkanoyloxy, alkoxy, hydroxy or halogen substituent.

More recently, certain poly(oxyalkylene) esters have been shown to reduce engine deposits when used in fuel compositions. U.S. Pat. No. 5,211,721, issued May 18, 1993 to R. L. Sung et al., for example, discloses an oil soluble polyether additive comprising the reaction product of a polyether polyol with an acid represented by the formula RCOOH in which R is a hydrocarbyl radical having 6 to 27 carbon atoms. The poly(oxyalkylene) ester compounds of this patent are taught to be useful for inhibiting carbonaceous deposit formation, motor fuel hazing, and as ORI inhibitors when employed as soluble additives in motor fuel compositions.

Poly(oxyalkylene) esters of amino- and nitrobenzoic acids are also known in the art. For example, U.S. Pat. No. 2,714,607, issued Aug. 2, 1955 to M. Matter, discloses polyethoxy esters of aminobenzoic acids, nitrobenzoic acids and other isocyclic acids. These polyethoxy esters are taught to have excellent pharmacological properties and to be useful as anesthetics, spasmolytics, analeptics and bacteriostatics.

Similarly, U.S. Pat. No. 5,090,914, issued Feb. 25, 1992 to D. T. Reardan et al., discloses poly(oxyalkylene) aromatic compounds having an amino or hydrazinocarbonyl substituent on the aromatic moiety and an ester, amide, carbamate, urea or ether linking group between the aromatic moiety and the poly(oxyalkylene) moiety. These compounds are taught to be useful for modifying macromolecular species such as proteins and enzymes.

U.S. Pat. No. 4,328,322, issued Sep. 22, 1980 to R. C. Baron, discloses amino- and nitrobenzoate esters of oligomeric polyols, such as poly(ethylene) glycol. These materials are used in the production of synthetic polymers by reaction with a polyisocyanate.

In addition, U.S. Pat. No. 4,231,759, issued Nov. 4, 1980 to Udelhofen et al., discloses a fuel additive composition comprising the Mannich condensation product of (1) a high molecular weight alkyl-substituted hydroxyaromatic compound wherein the alkyl group has a number average molecular weight of about 600 to about 3,000, (2) an amine, and (3) an aidehyde. This patent teaches that such Mannich condensation products provide carburetor cleanliness when employed alone, and intake valve cleanliness when employed in combination with a hydrocarbon carrier fluid.

U.S. Pat. No. 4,859,210, issued Aug. 22, 1989 to Franz et al., discloses fuel compositions containing (1) one or more polybutyl or polyisobutyl alcohols wherein the polybutyl or polyisobutyl group has a number average molecular weight of 324 to 3,000, or (2) a poly(alkoxylate) of the polybutyl or polyisobutyl alcohol, or (3) a carboxylate ester of the polybutyl or polyisobutyl alcohol. This patent further teaches that when the fuel composition contains an ester of a polybutyl or polyisobutyl alcohol, the ester-forming acid group may be derived from saturated or unsaturated, aliphatic or aromatic, acyclic or cyclic mono- or polycarboxylic acids.

U.S. Pat. No. 3,285,855, issued Nov. 15, 1966 to Dexter et al., discloses alkyl esters of dialkyl hydroxybenzoic and hydroxyphenylalkanoic acids wherein the ester moiety contains from 6 to 30 carbon atoms. This patent teaches that such esters are useful for stabilizing polypropylene and other organic material normally subject to oxidative deterioration. Similar alkyl esters containing hindered dialkyl hydroxyphenyl groups are disclosed in U.S. Pat. No. 5,196,565, which issued Mar. 23, 1993 to Ross.

U.S. Pat. No. 5,196,142, issued Mar. 23, 1993 to Mollet et al., discloses alkyl esters of hydroxyphenyl carboxylic acids wherein the ester moiety may contain up to 23 carbon atoms. This patent teaches that such compounds are useful as antioxidants for stabilizing emulsion-polymerized polymers.

It has now been discovered that certain polyalkyl nitro and amino aromatic esters provide excellent control of engine deposits, especially intake valve deposits, when employed as fuel additives in fuel compositions.

SUMMARY OF THE INVENTION

The present invention provides novel polyalkyl nitro and amino aromatic esters which are useful as fuel additives for the prevention and control of engine deposits, particularly intake valve deposits.

The polyalkyl nitro and amino aromatic esters of the present invention have the formula:

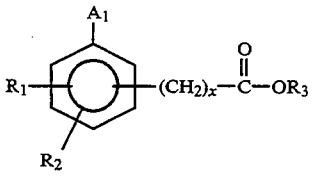

(I)

wherein $A_1$ is nitro, amino, N-alkylamino wherein the alkyl group contains 1 to 6 carbon atoms, or N,N-dialkylamino wherein each alkyl group independently contains 1 to 6 carbon atoms; $R_1$ and $R_2$ are each independently hydrogen, hydroxy, lower alkyl having 1 to 6 carbon atoms, or lower alkoxy having 1 to 6 carbon atoms; $R_3$ is a polyalkyl group having a weight average molecular weight in the range of about 450 to 5,000; and x is an integer from 0 to 10.

The present invention further provides a fuel composition comprising a major amount of hydrocarbons boiling in the gasoline or diesel range and an effective deposit-controlling amount of a polyalkyl nitro or amino aromatic ester of the present invention.

The present invention additionally provides a fuel concentrate comprising an inert stable oleophilic organic solvent boiling in the range of from about 150° F. to 400° F. and from about 10 to 70 weight percent of a polyalkyl nitro or amino aromatic ester of the present invention.

Among other factors, the present invention is based on the surprising discovery that certain polyalkyl nitro and amino aromatic esters provide excellent control of engine deposits, especially on intake valves, when employed as fuel additives in fuel compositions.

DETAILED DESCRIPTION OF THE INVENTION

The fuel additives provided by the present invention have the general formula:

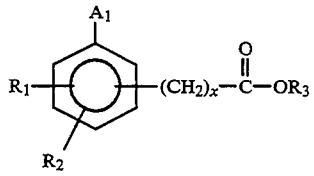

(I)

wherein $A_1$, $R_1$, $R_2$, $R_3$, and x are as defined hereinabove.

In formula I, $A_1$ is preferably a nitro, amino, or N-alkylamino group. More preferably, $A_1$ is a nitro or amino group. Most preferably, $A_1$ is an amino group.

Preferably, $R_1$ is hydrogen, hydroxy, or lower alkyl having 1 to 4 carbon atoms. More preferably, $R_1$ is hydrogen or hydroxy. Most preferably, $R_1$ is hydroxy.

$R_2$ is preferably hydrogen.

Preferably, $R_3$ is a polyalkyl group having a weight average molecular weight in the range of about 500 to 5,000, more preferably about 500 to 3,000, and most preferably about 600 to 2,000.

Preferably, x is an integer from 0 to 2. More preferably, x is 0.

A preferred group of polyalkyl aromatic esters are those of formula I wherein $R_1$ is hydrogen, hydroxy, or lower alkyl having 1 to 4 carbon atoms; $R_2$ is hydrogen; and x is 0.

Another preferred group of polyalkyl aromatic esters are those of formula I wherein $R_1$ is hydrogen, hydroxy, or lower alkyl having 1 to 4 carbon atoms; $R_2$ is hydrogen; and x is 1 or 2.

A more preferred group of polyalkyl aromatic esters are those of formula I wherein R! is hydrogen or hydroxy; $R_2$ is hydrogen; and x is 0.

A particularly preferred group of polyalkyl aromatic esters are those wherein $R_1$ is hydroxy, $R_2$ is hydrogen, and x is 0.

When $A_1$ is an N-alkylamino group, the alkyl group of the N-alkylamino moiety preferably contains 1 to 4 carbon atoms. More preferably, the alkyl group is methyl or ethyl. For example, particularly preferred N-alkylamino groups are N-methylamino and N-ethylamino groups.

Similarly, when $A_1$ is an N,N-dialkylamino group, each alkyl group of the N,N-dialkylamino moiety preferably contains 1 to 4 carbon atoms. More preferably, each alkyl group is either methyl or ethyl. For example, particularly preferred N,N-dialkylamino groups are N,N-dimethylamino, N-ethyl-N-methylamino and N,N-diethylamino groups.

A further preferred group of polyalkyl aromatic esters are those wherein $A_1$ is amino or nitro, $R_1$ is hydrogen or hydroxy, $R_2$ is hydrogen, and x is 0, 1 or 2. A more preferred group of polyalkyl aromatic esters are those wherein $A_1$ is amino or nitro, $R_1$ is hydrogen or hydroxy, $R_2$ is hydrogen, and x is 0. A particularly preferred group of polyalkyl aromatic esters are those wherein $A_1$ is amino or nitro, $R_1$ is hydroxy, $R_2$ is hydrogen, and x is 0.

It is especially preferred that the nitro, amino, N-alkylamino or N,N-dialkylamino substituent present in the aromatic moiety of the polyalkyl aromatic esters of this invention be situated in a meta or para position relative to the polyalkyl ester moiety. When the aromatic moiety also contains a hydroxyl substituent, it is particularly preferred that this hydroxyl group be in a meta or para position relative to the polyalkyl ester moiety and in an ortho position relative to the nitro, amino, N-alkylamino or N,N-dialkylamino substituent.

The polyalkyl aromatic esters of the present invention will generally have a sufficient molecular weight so as to be non-volatile at normal engine intake valve operating temperatures (about 200°–250° C.). Typically, the molecular weight of the polyalkyl hydroxyaromatic esters of this invention will range from about 600 to about 6,000, preferably from 600 to 3,000, more preferably from 700 to 2,000.

Fuel-soluble salts of the polyalkyl aromatic esters of the present invention can be readily prepared for those compounds containing an amino, N-alkylamino or N,N-dialkylamino group and such salts are contemplated to be useful for preventing or controlling engine deposits. Suitable salts include, for example, those obtained by protonating the amino moiety with a strong organic acid, such as an alkyl- or arylsulfonic acid. Preferred salts are derived from toluenesulfonic acid and methanesulfonic acid.

DEFINITIONS

As used herein, the following terms have the following meanings unless expressly stated to the contrary.

The term "amino" refers to the group: $—NH_2$.

The term "N-alkylamino" refers to the group: $—NHR_a$ wherein $R_a$ is an alkyl group The term "N N-dialkylamino" refers to the group: $—NR_bR_c$, wherein $R_b$ and $R_c$ are alkyl groups.

The term "alkyl"refers to both straight- and branched-chain alkyl groups.

The term "lower alkyl" refers to alkyl groups having 1 to about 6 carbon atoms and includes primary, secondary and tertiary alkyl groups. Typical lower alkyl groups include, for example, methyl, ethyl, n-propyl, isopropyl, n-butyl, sec-butyl, t-butyl, n-pentyl, n-hexyl and the like.

The term "lower alkoxy" refers to the group $—OR_d$ wherein $R_d$ is lower alkyl. Typical lower alkoxy groups include methoxy, ethoxy, and the like.

The term "polyalkyl" refers to alkyl groups which are generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

GENERAL SYNTHETIC PROCEDURES

The polyalkyl nitro and amino aromatic esters of this invention may be prepared by the following general methods and procedures. It should be appreciated that where typical or preferred process conditions (e.g., reaction temperatures, times, mole ratios of reactants, solvents, pressures, etc.) are given, other process conditions may also be used unless otherwise stated. Optimum reaction conditions may vary with the particular reactants or solvents used, but such conditions can be determined by one skilled in the art by routine optimization procedures.

Moreover, those skilled in the art will recognize that it may be necessary to block or protect certain functional groups while conducting the following synthetic procedures. In such cases, the protecting group will serve to protect the functional group from undesired reactions or to block its undesired reaction with other functional groups or with the reagents used to carry out the desired chemical transformations. The proper choice of a protecting group for a particular functional group will be readily apparent to one skilled in the art. Various protecting groups and their introduction and removal are described, for example, in T. W. Greene and P. G. M. Wuts, *Protective Groups in Organic Synthesis,* Second Edition, Wiley, New York, 1991, and references cited therein.

In the present synthetic procedures, a hydroxyl group will preferably be protected, when necessary, as the benzyl or tert-butyldimethylsilyl ether. Introduction and removal of these protecting groups is well described in the art. Amino groups may also require protection and this may be accomplished by employing a standard amino protecting group, such as a benzyloxycarbonyl or a trifluoroacetyl group. Additionally, as will be discussed in further detail hereinbelow, the polyalkyl aromatic esters of this invention having an amino group on the aromatic moiety will generally be prepared from the corresponding nitro derivative. Accordingly, in many of the following procedures, a nitro group will serve as a protecting group for the amino moiety.

The polyalkyl aromatic esters of the present invention having the formula:

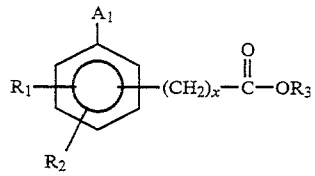

(III)

wherein $A_1$, $R_1$, $R_2$, $R_3$ and x are as defined above, may be prepared by esterifying an aromatic carboxylic acid having the formula:

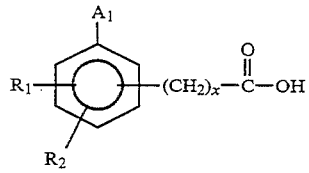

(IV)

wherein $A_1$, $R_1$, $R_2$, and x are as defined above, with a polyalkyl alcohol having the formula:

$HO\text{-}R_3$ (V)

wherein $R_3$ is as defined above, using conventional esterification reaction conditions.

The aromatic carboxylic acids of formula IV are either known compounds or can be prepared from known compounds by conventional procedures. Representative aromatic carboxylic acids suitable for use as starting materials include, for example, 2-aminobenzoic acid (anthranilic acid), 3-aminobenzoic acid, 4-aminobenzoic acid, 0 3-amino-4-hydroxybenzoic acid, 4-amino-3-hydroxybenzoic acid, 3-aminophenylacetic acid, 4-aminophenylacetic acid, 3-amino-4-methoxybenzoic acid, 4-amino-3-methoxybenzoic acid, 4-amino-3-methylbenzoic acid, 4-amino-3,5-di-t-butylbenzoic acid, 2-nitrobenzoic acid, 3-nitrobenzoic acid, 4-nitrobenzoic acid, 2-nitrophenylacetic acid, 3-nitrophenylacetic acid, 4-nitrophenylacetic acid, 3-hydroxy-4-nitrobenzoic acid, 4-hydroxy-3-nitrobenzoic acid, 4-hydroxy-3-nitrophenylacetic acid, 3-(N-methylamino)benzoic acid, 4-(N-methylamino)benzoic acid, 3-(N-ethylamino)benzoic acid, 4-(N-ethylamino)-benzoic acid, 3-(N,N-dimethylamino)benzoic acid, 4-(N,N-dimethylamino)benzoic acid, and the like.

Preferred aromatic carboxylic acids include 3-aminobenzoic acid, 4-aminobenzoic acid, 3-amino-4-hydroxybenzoic acid, 4-amino-3-hydroxybenzoic acid, 3-nitrobenzoic acid, 4-nitrobenzoic acid, 3-hydroxy-4-nitrobenzoic and 4-hydroxy-3-nitrobenzoic acid.

The polyalkyl alcohols of formula V may also be prepared by conventional procedures known in the art. Such procedures are taught, for example, in U.S. Pat. Nos. 5,055,607 to Buckley and 4,859,210 to Franz et al., the disclosures of which are incorporated herein by reference.

In general, the polyalkyl substituent on the polyalkyl alcohols of Formula V and the resulting polyalkyl aromatic esters of the present invention will have a weight average molecular weight in the range of about 450 to 5,000, preferably about 500 to 5,000, more preferably about 500 to 3,000, and most preferably about 600 to 2,000.

The polyalkyl substituent on the polyalkyl alcohols employed in the invention may be generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The preferred polyisobutenes used to prepare the presently employed polyalkyl alcohols are polyisobutenes which comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808. Such polyisobutenes, known as "reactive" polyisobutenes, yield high molecular weight alcohols in which the hydroxyl group is at or near the end of the hydrocarbon chain.

Examples of suitable polyisobutenes having a high alkylvinylidene content include Ultravis 30, a polyisobutene having a molecular weight of about 1300 and a methylvinylidene content of about 74%, and Ultravis 10, a polyisobutene having a molecular weight of about 950 and a methylvinylidene content of about 76%, both available from British Petroleum.

The polyalkyl alcohols may be prepared from the corresponding olefins by conventional procedures. Such procedures include hydration of the double bond to give an alcohol. Suitable procedures for preparing such long-chain alcohols are described in I. T. Harrison and S. Harrison, *Compendium of Organic Synthetic Methods,* Wiley-Interscience, New York (1971), pp. 119–122, as well as in U.S. Pat. Nos. 5,055,607 and 4,859,210.

As indicated above, the polyalkyl aromatic esters of formula III may be prepared by esterifying an aromatic carboxylic acid of formula IV with a polyalkyl alcohol of formula V under conventional esterification reaction conditions.

Typically, this reaction will be conducted by contacting a polyalkyl alcohol of formula V with about 0.25 to about 1.5 molar equivalents of an aromatic carboxylic acid of formula IV in the presence of an acidic catalyst at a temperature in the range of about 70° C. to about 160° C. for about 0.5 to about 48 hours. Suitable acid catalysts for this reaction include p-toluene sulfonic acid, methanesulfonic acid and the like. The reaction may be conducted in the presence or absence of an inert solvent, such as benzene, toluene and the like. The water generated by this reaction is preferably removed during the course of the reaction by, for example, azeotropic distillation with an inert solvent, such as toluene.

Alternatively, the polyalkyl aromatic esters of formula III may be prepared by reacting a polyalkyl alcohol of formula V with an acid halide derived from an aromatic carboxylic acid of formula IV, such as an acid chloride or acid bromide.

Generally, the carboxylic acid moiety of formula IV may be converted into an acyl halide moiety by contacting a compound of formula IV with an inorganic acid halide, such as thionyl chloride, phosphorous trichloride, phosphorous tribromide, or phosphorous pentachloride; or with oxalyl chloride. Typically, this reaction will be conducted using about 1 to 5 molar equivalents of the inorganic acid halide or oxalyl chloride, either neat or in an inert solvent, such as diethyl ether, at a temperature in the range of about 20° C. to about 80° C. for about 1 to about 48 hours. A catalyst, such as N,N-dimethylformamide, may also be used in this reaction.

Reaction of the acid halide derived from formula IV with a polyalkyl alcohol of formula V provides a polyalkyl aromatic ester of formula III. Typically, this reaction is conducted by contacting formula V with about 0.9 to about 1.5 molar equivalents of the acid halide in an inert solvent, such as toluene, dichloromethane, diethyl ether, and the like, at a temperature in the range of about 25° C. to about 150° C. The reaction is generally complete in about 0.5 to about 48 hours. Preferably, the reaction is conducted in the presence of a sufficient amount of an amine capable of neutralizing the acid generated during the reaction, such as triethylamine, di(isopropyl)ethylamine, pyridine or 4-dimethylaminopyridine.

When the aromatic carboxylic acid of formula IV contains a hydroxyl group, for example, when $R_1$ or $R_2$ is hydroxyl, protection of the aromatic hydroxyl groups may be accomplished using well-known procedures. The choice of a suitable protecting group for a particular hydroxyaromatic carboxylic acid will be apparent to those skilled in the art. Various protecting groups, and their introduction and removal, are described, for example, in T. W. Greene and P. G. M. Wuts, Protective Groups in *Organic Synthesis,* Second Edition, Wiley, New York, 1991, and references cited therein.

Deprotection of the aromatic hydroxyl group(s) can also be accomplished using conventional procedures. Appropriate conditions for this deprotection step will depend upon the protecting group(s) utilized in the synthesis and will be readily apparent to those skilled in the art. For example, benzyl protecting groups may be removed by hydrogenolysis under 1 to about 4 atmospheres of hydrogen in the presence of a catalyst, such as palladium on carbon. Typically, this deprotection reaction is conducted in an inert solvent, preferably a mixture of ethyl acetate and acetic acid, at a temperature of from about 0° C. to about 40° C. for about 1 to about 24 hours.

When synthesizing the polyalkyl aromatic esters of formula I having an amino group on the aromatic moiety (i.e., where $A_1$ is an amino group), it is generally desirable to first prepare the corresponding nitro compound (i.e., where $A_1$ is a nitro group) using the above-described synthetic procedures, and then to reduce the nitro group to an amino group using conventional procedures. Aromatic nitro groups may be reduced to amino groups using a number of procedures that are well known in the art. For example, aromatic nitro groups may be reduced under catalytic hydrogenation conditions; or by using a reducing metal, such as zinc, tin, iron and the like, in the presence of an acid, such as dilute hydrochloric acid.

Generally, reduction of the nitro group by catalytic hydrogenation is preferred. Typically, this reaction is conducted using about 1 to 4 atmospheres of hydrogen and a platinum or palladium catalyst, such as palladium on carbon. The reaction is typically carried out at a temperature of about 0° C. to about 100° C. for about i to 24 hours in an inert solvent, such as ethanol, ethyl acetate and the like. Hydrogenation of aromatic nitro groups is discussed in further detail in, for example, P. N. Rylander, *Catalytic Hydrogenation in Organic Synthesis,* pp. 113–137, Academic Press (1979); and *Organic Synthesis,* Collective Vol. I, Second Edition, pp. 240–241, John Wiley & Sons, Inc. (1941); and references cited therein.

FUEL COMPOSITIONS

The polyalkyl aromatic esters of the present invention are useful as additives in hydrocarbon fuels to prevent and control engine deposits, particularly intake valve deposits. The proper concentration of additive necessary to achieve the desired deposit control varies depending upon the type of fuel employed, the type of engine, and the presence of other fuel additives.

In general, the concentration of the polyalkyl aromatic esters of this invention in hydrocarbon fuel will range from about 50 to about 2500 parts per million (ppm) by weight, preferably from 75 to 1,000 ppm. When other deposit control additives are present, a lesser amount of the present additive may be used.

The polyalkyl aromatic esters of the present invention may be formulated as a concentrate using an inert stable oleophilic (i.e., dissolves in gasoline) organic solvent boiling in the range of about 150° F. to 400° F. (about 65° C. to 205° C.). Preferably, an aliphatic or an aromatic hydrocarbon solvent is used, such as benzene, toluene, xylene or higher-boiling aromatics or aromatic thinners. Aliphatic alcohols containing about 3 to 8 carbon atoms, such as isopropanol, isobutylcarbinol, n-butanol and the like, in combination with hydrocarbon solvents are also suitable for use with the present additives. In the concentrate, the amount of the additive will generally range from about 10 to about 70 weight percent, preferably 10 to 50 weight percent, more preferably from 20 to 40 weight percent.

In gasoline fuels, other fuel additives may be employed with the additives of the present invention, including, for example, oxygenates, such as t-butyl methyl ether, antiknock agents, such as methylcyclopentadienyl manganese tricarbonyl, and other dispersants/detergents, such as hydrocarbyl amines, hydrocarbyl poly(oxyalkylene) amines, or succinimides. Additionally, antioxidants, metal deactivators and demulsifiers may be present.

In diesel fuels, other well-known additives can be employed, such as pour point depressants, flow improvers, cetane improvers, and the like.

A fuel-soluble, nonvolatile carrier fluid or oil may also be used with the polyalkyl aromatic esters of this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, and synthetic polyoxyalkylene-derived oils, such as those described, for example, in U.S. Pat. No. 4,191,537 to Lewis, and polyesters, such as those described, for example, in U.S. Pat. Nos. 3,756,793 and 5,004,478 to Robinson and Vogel et al., respectively, and in European Patent Application Nos. 356,726 and 382,159, published Mar. 7, 1990 and Aug. 16, 1990, respectively.

These carrier fluids are believed to act as a carrier for the fuel additives of the present invention and to assist in removing and retarding deposits. The carrier fluid may also exhibit synergistic deposit control properties when used in combination with a polyalkyl aromatic ester of this invention.

The carrier fluids are typically employed in amounts ranging from about 100 to about 5000 ppm by weight of the hydrocarbon fuel, preferably from 400 to 3000 ppm of the fuel. Preferably, the ratio of carrier fluid to deposit control additive will range from about 0.5:1 to about 10:1, more preferably from 1:1 to 4:1, most preferably about 2:1.

When employed in a fuel concentrate, carrier fluids will generally be present in amounts ranging from about 20 to about 60 weight percent, preferably from 30 to 50 weight percent.

EXAMPLES

The following examples are presented to illustrate specific embodiments of the present invention and synthetic preparations thereof; and should not be interpreted as limitations upon the scope of the invention.

EXAMPLE 1

Preparation of Polyisobutyl-4-Nitrobenzoate

4-Nitrobenzoyl chloride (12.7 grams) was combined with 47.6 grams of polyisobutanol (molecular weight average 984, prepared via hydroformylation of Amoco H-100 polyisobutene) and 300 mL of anhydrous toluene. Triethylamine (10.0 mL) and 4-dimethylaminopyridine (4.2 grams) were then added and the resulting mixture heated to reflux under nitrogen for sixteen hours. The reaction was cooled to room temperature and diluted with diethyl ether. The organic layer was washed twice with 1% aqeous hydrochloric acid, twice with aqeous sodium bicarbonate solution, and once with brine. The organic layer was then dried over anhydrous magnesium sulfate, filtered and the solvents removed in vacuo to yield 41.9 grams of a yellow oil. The oil was chromatographed on silica gel, eluting with hexane/ethylacetate/ethanol (9:0.8:0.2) to yield 37.2 grams of the desired product as a light yellow oil. IR (neat) 1725 $cm^{-1}$, $^1H$ NMR ($CDCl_3$) δ 8.3, 8.2 (AB quartet, 4H), 4.35 (t, 2H), 0.6–1.8 (m, 137H).

EXAMPLE 2

Preparation of Polyisobutyl-4-Aminobenzoate

A solution of 30.75 grams of the product from Example 1 in 220 mL of ethyl acetate containing 3.5 grams of 10% palladium on charcoal was hydrogenated at 35–40 psi for 16 hours on a Parr low-pressure hydrogenator. Catalyst filtration and removal of the solvent in vacuo yielded 29.44 grams of the desired product as a light yellow oil. IR (neat) 1709, 1696 $cm^{-1}$. $^1H$ NMR ($CDCl_3$) δ 7.9 d, 2H), 6.65 (d, 2H), 4.3 (t, 2H), 4.1 (bs, 2H), 0.6–1.8 (m, 137H).

EXAMPLE 3

Preparation of Polyisobutyl-3-Nitro-4-Hydroxybenzoate

To a flask equipped with a mechanical stirrer, thermometer, Dean-Stark trap, reflux condensor and nitrogen inlet was added 35.0 grams of polyisobutanol (molecular weight average 984, prepared via hydroformylation of Amoco H-100 polyisobutene), 11.0 grams of 3-nitro-4-hydroxybenzoic acid and 0.86 grams of p-toluene sulfonic acid. The mixture was stirred at 130° C. for sixteen hours, cooled to room temperature and diluted with 500 mL of diethyl ether. The organic phase was washed twice with saturated aqeous sodium bicarbonate solution, once with brine, dried over anhydrous magnesium sulfate, filtered and concentrated in vacuo to yield 35.0 grams of a brown oil. The oil was chromatographed on silica gel eluting with hexane/ethyl acetate/ethanol (8:1.8:0.2) to yield 25.4 grams of the desired product as a light brown oil. IR (neat) 1721$cm^{-1}$. $^1H$ NMR ($CDCl_3$) δ 10.9 (s, 1H), 8.85 (s, 1H), 8.25 (d, 1H), 7.2 (d, 1H), 4.35 (t, 2H), 0.6–1.8 (m, 137H).

EXAMPLE 4

Preparation of Polyisobutyl-3-Hydroxy-4-Nitrobenzoate

To a flask equipped with a mechanical stirrer, thermometer, Dean-Stark trap, reflux condensor and nitrogen inlet was added 35.0 grams of polyisobutanol (molecular weight average 984, prepared via hydroformylation of Amoco H-100 polyisobutene), 11.0 grams of 3-hydroxy-4-nitrobenzoic acid and 0.86 grams of p-toluene sulfonic acid. The mixture was stirred at 130° C. for sixteen hours, cooled to room temperature and diluted with 500 mL of diethyl ether. The organic phase was washed twice with saturated aqeous sodium bicarbonate solution, once with brine, dried over anhydrous magnesium sulfate, filtered and concentrated in vacuo to yield 37.8 grams of a black oil. The oil was chromatographed on silica gel eluting with hexane/ethyl acetate/ethanol (8:1.8:0.2) to yield 27.9 grams of the desired product as a brown oil. IR (neat) 1731$cm^{-1}$. $^1H$ NMR ($CDCl_3$) δ 10.5 (s, 1H), 8.2 (d, 1H), 7.8 (s, 1H), 7.65 (d, 1H), 4.35 (t, 2H), 0.6–1.8 (m, 137H).

EXAMPLE 5

Preparation of Polyisobutyl-3-Amino-4-Hydroxybenzoate

A solution of 19.0 grams of the product from Example 3 in 200 mL of ethyl acetate containing 3.0 grams of 10% palladium on charcoal was hydrogenolyzed at 35–40 psi for sixteen hours on a Parr low-pressure hydrogenator. Catalyst filtration and removal of the solvent in vacuo yielded 17.4 grams of the desired product as a light brown oil. IR (neat) 1716, 1682 $cm^{-1}$. $^1H$ NMR ($CDCl_3$) δ 7.45 (m, 2H), 6.75 (d, 1H), 4.3 (t, 2H), 0.6–1.8 (m, 137H).

EXAMPLE 6

Preparation of Polyisobutyl-3-Hydroxy-4-Aminobenzoate

A solution of 21.35 grams of the product from Example 4 in 200 mL of ethyl acetate containing 3.0 grams of 10% palladium on charcoal was hydrogenolyzed at 35–40 psi for sixteen hours on a Parr low-pressure hydrogenator. Catalyst filtration and removal of the solvent in vacuo yielded 20.6 grams of the desired product as a light brown oil. IR (neat) 1709, 1682 $cm^{-1}$. $^1H$ NMR ($CDCl_3$) δ 7.6 (s, 1H), 7.5 (d, 1H), 6.7 (d, 1H), 4.3 (t, 2H), 0.6–1.8 (m, 137H).

EXAMPLE 7

Single-Cylinder Engine Test

The test compounds were blended in gasoline and their deposit reducing capacity determined in an ASTM/CFR single-cylinder engine test.

A Waukesha CFR single-cylinder engine was used. Each run was carried out for 15 hours, at the end of which time the intake valve was removed, washed with hexane and weighed. The previously determined weight of the clean valve was subtracted from the weight of the value at the end of the run. The differences between the two weights is the weight of the deposit. A lesser amount of deposit indicates a superior additive. The operating conditions of the test were as follows: water jacket temperature 200° F.; vacuum of 12 in Hg, air-fuel ratio of 12, ignition spark timing of 40°BTC; engine speed is 1800 rpm; the crankcase oil is a commercial 30W oil.

The amount of carbonaceous deposit in milligrams on the intake valves is reported for each of the test compounds in Table I.

TABLE I

| | Intake Valve Deposit Weight (in milligrams) | | |
|---|---|---|---|
| Sample[1] | Run 1 | Run 2 | Average |
| Base Fuel | 176.4 | 179.2 | 177.8 |

TABLE I-continued

| Sample[1] | Intake Valve Deposit Weight (in milligrams) Run 1 | Run 2 | Average |
|---|---|---|---|
| Example 1 | 171.0 | 159.4 | 165.2 |
| Example 2 | 10.0 | 16.6 | 13.3 |
| Example 3 | 130.0 | 143.5 | 136.8 |
| Example 4 | 139.0 | 127.0 | 133.0 |
| Example 5 | 0.0 | 0.4 | 0.2 |
| Example 6 | 0.0 | 0.2 | 0.1 |

[1]At 200 parts per million actives (ppma).

The base fuel employed in the above single-cylinder engine tests was a regular octane unleaded gasoline containing no fuel detergent. The test compounds were admixed with the base fuel to give a concentration of 200 ppma (parts per million actives).

The data in Table I illustrates the significant reduction in intake valve deposits provided by the polyalkyl aromatic esters of the present invention (Examples 1, 2, 3, 4, 5 and 6) compared to the base fuel.

EXAMPLE 8

Multicylinder Engine Test

The polyalkyl aromatic esters of the present invention were tested in a laboratory multicylinder engine to evaluate their intake valve and combustion chamber deposit control performance. The test engine was a 4.3 liter, TBI (throttle body injected), V6 engine manufactured by General Motors Corporation.

The major engine dimensions are set forth in Table II:

TABLE II

| Engine Dimensions | |
|---|---|
| Bore | 10.16 cm |
| Stroke | 8.84 cm |
| Displacement Volume | 4.3 liter |
| Compression Ratio | 9.3:1 |

The test engine was operated for 40 hours (24 hours a day) on a prescribed load and speed schedule representative of typical driving conditions. The cycle for engine operation during the test is set forth in Table III.

TABLE III

| Engine Driving Cycle | | | | |
|---|---|---|---|---|
| Step | Mode | Time in Mode [Sec][1] | Dynamometer Load [kg] | Engine Speed [RPM] |
| 1 | Idle | 60 | 0 | 800 |
| 2 | City Cruise | 150 | 10 | 1,500 |
| 3 | Acceleration | 40 | 25 | 2,800 |
| 4 | Heavy HWY Cruise | 210 | 15 | 2,200 |
| 5 | Light HWY Cruise | 60 | 10 | 2,200 |
| 6 | Idle | 60 | 0 | 800 |
| 7 | City Cruise | 180 | 10 | 1,500 |
| 8 | Idle | 60 | 0 | 800 |

[1]All steps, except step number 3, include a 15 second transition ramp. Step 3 includes a 20 second transition ramp.

All of the test runs were made with the same base gasoline, which was representative of commercial unleaded fuel. The results are set forth in Table IV.

TABLE IV

| Sample[1] | Multicylinder Engine Test Results | Intake Valve Deposits[2] | Combustion Chamber Deposits[2] |
|---|---|---|---|
| Base Fuel | Run 1 | 710 | 2339 |
| | Run 2 | 962 | 2059 |
| | Average | 836 | 2199 |
| Example 5 | Run 1 | 165 | 2596 |
| | Run 2 | 143 | 2566 |
| | Average | 154 | 2581 |

[1]At 200 parts per million actives (ppma) plus 800 ppm Chevron 500 neutral oil.
[2]In milligrams (mg).

The base fuel employed in the above multicylinder engine tests contained no fuel detergent. The test compounds were admixed with the base fuel to give a concentration of 200 ppma (parts per million actives) plus 800 ppm of the carrier fluid Chevron 500 neutral oil.

The data in Table IV illustrates the significant reduction in intake valve deposits provided by the polyalkyl aromatic esters of the present invention (Example 5) compared to the base fuel. Moreover, the data in Table IV further demonstrates that the polyalkyl aromatic esters of the present invention do not contribute significantly to combustion chamber deposits.

What is claimed is:

1. A compound of the formula:

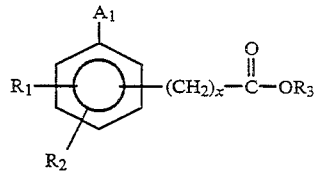

wherein $A_1$ is nitro, amino, N-alkylamino wherein the alkyl group contains 1 to 6 carbon atoms, or N,N-dialkylamino wherein each alkyl group independently contains 1 to 6 carbon atoms;

$R_1$ and $R_2$ are independently hydrogen, hydroxy, lower alkyl having 1 to 6 carbon atoms, or lower alkoxy having 1 to 6 carbon atoms;

$R_3$ is a polyalkyl group having a weight average molecular weight in the range of about 450 to 5,000; and x is an integer from 0 to 10.

2. The compound according to claim 1, wherein $R_1$ is hydrogen, hydroxy, or lower alkyl having 1 to 4 carbon atoms.

3. The compound according to claim 2, wherein $R_1$ is hydrogen or hydroxy.

4. The compound according to claim 3, wherein $R_1$ is hydroxy.

5. The compound according to claim 1, wherein $R_2$ is hydrogen.

6. The compound according to claim 1, wherein x is 0, 1 or 2.

7. The compound according to claim 6, wherein $R_1$ and R2 are hydrogen, and x is 0.

8. The compound according to claim 6, wherein $R_1$ is hydroxy, $R_2$ is hydrogen, and x is 0.

9. The compound according to claim 1, wherein $A_1$ is nitro or amino.

10. The compound according to claim 9, wherein $A_1$ is amino.

11. The compound according to claim 1, wherein $R_3$ is a polyalkyl group having a weight average molecular weight in the range of about 500 to 5,000.

12. The compound according to claim 11, wherein $R_3$ has a weight average molecular weight in the range of about 500 to 3,000.

13. The compound according to claim 12, wherein $R_3$ has a weight average molecular weight in the range of about 600 to 2,000.

14. The compound according to claim 1, wherein $R_3$ is a polyalkyl group derived from polypropylene, polybutene, or polyalphaolefin oligomers of 1-octene or 1-decene.

15. The compound according to claim 14, wherein $R_3$ is derived from polyisobutene.

16. The compound according to claim 15, wherein the polyisobutene contains at least about 20% of a methylvinylidene isomer.

17. A fuel composition comprising a major amount of hydrocarbons boiling in the gasoline or diesel range and an effective detergent amount of a compound of the formula:

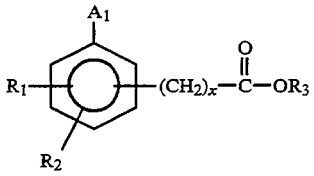

wherein $A_1$ is nitro, amino, N-alkylamino wherein the alkyl group contains 1 to 6 carbon atoms, or N,N-dialkylamino wherein each alkyl group independently contains 1 to 6 carbon atoms;

$R_1$ and $R_2$ are independently hydrogen, hydroxy, lower alkyl having 1 to 6 carbon atoms, or lower alkoxy having 1 to 6 carbon atoms;

$R_3$ is a polyalkyl group having a weight average molecular weight in the range of about 450 to 5,000; and x is an integer from 0 to 10.

18. The fuel composition according to claim 17, wherein $R_1$ is hydrogen, hydroxy, or lower alkyl having 1 to 4 carbon atoms.

19. The fuel composition according to claim 18, wherein $R_1$ is hydrogen or hydroxy.

20. The fuel composition according to claim 19, wherein $R_1$ is hydroxy.

21. The fuel composition according to claim 17, wherein $R_2$ is hydrogen.

22. The fuel composition according to claim 17, wherein x is 0, 1 or 2.

23. The fuel composition according to claim 22, wherein $R_1$ and $R_2$ are hydrogen, and x is 0.

24. The fuel composition according to claim 22, wherein $R_1$ is hydroxy, $R_2$ is hydrogen, and x is 0.

25. The fuel composition according to claim 17, wherein $A_1$ is nitro or amino.

26. The fuel composition according to claim 25, wherein $A_1$ is amino.

27. The fuel composition according to claim 17, wherein $R_3$ is a polyalkyl group having a weight average molecular weight in the range of about 500 to 5,000.

28. The fuel composition according to claim 27, wherein $R_3$ has a weight average molecular weight in the range of about 500 to 3,000.

29. The fuel composition according to claim 28, wherein $R_3$ has a weight average molecular weight in the range of about 600 to 2,000.

30. The fuel composition according to claim 17, wherein $R_3$ is a polyalkyl group derived from polypropylene, polybutene, or polyalphaolefin oligomers of 1-octene or 1-decene.

31. The fuel composition according to claim 30, wherein $R_3$ is derived from polyisobutene.

32. The fuel composition according to claim 31, wherein the polyisobutene contains at least about 20% of a methylvinylidene isomer.

33. The fuel composition according to claim 17, wherein said composition contains about 50 to about 2500 parts per million by weight of said compound.

34. A fuel concentrate comprising an inert stable oleophilic organic solvent boiling in the range of from about 150° F. to 400° F. and from about 10 to about 70 weight percent of a compound of the formula:

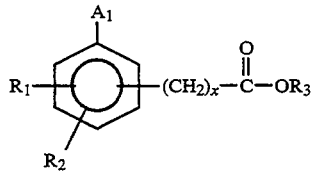

wherein $A_1$ is nitro, amino, N-alkylamino wherein the alkyl group contains 1 to 6 carbon atoms, or N,N-dialkylamino wherein each alkyl group independently contains 1 to 6 carbon atoms;

$R_1$ and $R_2$ are independently hydrogen, hydroxy, lower alkyl having 1 to 6 carbon atoms, or lower alkoxy having 1 to 6 carbon atoms;

$R_3$ is a polyalkyl group having a weight average molecular weight in the range of about 450 to 5,000; and x is an integer from 0 to 10.

35. The fuel concentrate according to claim 34, wherein $R_1$ is hydrogen, hydroxy, or lower alkyl having 1 to 4 carbon atoms.

36. The fuel concentrate according to claim 35, wherein $R_1$ is hydrogen or hydroxy.

37. The fuel concentrate according to claim 36, wherein $R_1$ is hydroxy.

38. The fuel concentrate according to claim 34, wherein $R_2$ is hydrogen.

39. The fuel concentrate according to claim 34, wherein x is 0, 1 or 2.

40. The fuel concentrate according to claim 39, wherein $R_1$ and $R_2$ are hydrogen, and x is 0.

41. The fuel concentrate according to claim 39, wherein $R_1$ is hydroxy, $R_2$ is hydrogen, and x is 0.

42. The fuel concentrate according to claim 34, wherein $A_1$ is nitro or amino.

43. The fuel concentrate according to claim 42, wherein $A_1$ is amino.

44. The fuel concentrate according to claim 34, wherein $R_3$ is a polyalkyl group having a weight average molecular weight in the range of about 500 to 5,000.

45. The fuel concentrate according to claim 44, wherein $R_3$ has a weight average molecular weight in the range of about 500 to 3,000.

46. The fuel concentrate according to claim 45, wherein $R_3$ has a weight average molecular weight in the range of about 600 to 2,000.

47. The fuel concentrate according to claim 34, wherein $R_3$ is a polyalkyl group derived from polypropylene, polybutene, or polyalphaolefin oligomers of 1-octene or 1-decene.

48. The fuel concentrate according to claim 47, wherein $R_3$ is derived from polyisobutene.

49. The fuel concentrate according to claim 48, wherein the polyisobutene contains at least about 20% of a methylvinylidene isomer.

* * * * *